US006239679B1

(12) United States Patent
Comtois et al.

(10) Patent No.: US 6,239,679 B1
(45) Date of Patent: May 29, 2001

(54) ELECTROMAGNETIC SWITCHING DEVICE

(75) Inventors: Patrick Comtois, Dijon; Patrick Larcher, Ahuy; Alain Moreux, Dijon; Régis Perrocheau, Couternon, all of (FR)

(73) Assignee: Schneider Electric Industries SA, Rueil-Malmaison (FR)

( * ) Notice: Subject to any disclaimer, the term of this patent is extended or adjusted under 35 U.S.C. 154(b) by 0 days.

(21) Appl. No.: 09/451,772

(22) Filed: Dec. 1, 1999

(30) Foreign Application Priority Data

Dec. 1, 1998 (FR) ..... 98-15-184

(51) Int. Cl.[7] ..... H01H 67/02; H01H 9/00

(52) U.S. Cl. ..... 335/132; 335/127; 335/129; 335/131; 335/203

(58) Field of Search ..... 335/127, 129, 335/131, 132, 203

(56) References Cited

U.S. PATENT DOCUMENTS 3,824,509 7/1974 McGary ..... 335/132
5,281,937 1/1994 Young ..... 335/132
6,040,750 * 3/2000 Pfab ..... 335/156

FOREIGN PATENT DOCUMENTS 2027136 4/1972 (DE) .
2 259 429 8/1975 (FR) .
2 737 603 2/1997 (FR) .

* cited by examiner

*Primary Examiner*—Ramon M. Barrera
(74) *Attorney, Agent, or Firm*—Oblon, Spivak, McClelland, Maier & Neustadt, P.C.

(57) ABSTRACT

Electromagnetic switching device including a movable contact-holder fitted with a set of contact bridges bearing movable power contacts that operate in conjunction with fixed contacts, and an electromagnet composed of a coil, a fixed framework and movable framework. The movable contact-holder includes an assembling device including at least one elastic clipping foot for fastening the movable contact-holder of the electromagnet to the movable contact-holder, characterized in that the assembling device is equally suitable for direct and indirect assembly of the movable framework onto the movable contact-holder according to the type of movable framework used in DC or AC electromagnets.

10 Claims, 4 Drawing Sheets

ELECTROMAGNETIC SWITCHING DEVICE

BACKGROUND OF THE INVENTION

1. Field of the Invention

The present invention relates to an electromagnetic switching device comprising a movable contact-holder fitted with a set of contact bridges that operate in conjunction with fixed contacts, also comprising an electromagnet composed of a coil, a fixed framework and movable framework, the movable framework of the electromagnet being associated with the contact-holder and causing the contact-holder to move in translation in order to open or close the contacts.

2. Discussion of the Background

French patent FR 2518308 discloses a contactor-type electromagnetic switching device comprising an electromagnet powered by an alternating current. The contact-holder of the contactor has a lower cavity containing the movable framework of the electromagnet, the movable framework being fastened by means of a pin passing through the framework and introduced into the body of the contact-holder on each side of the cavity. The movable framework of the electromagnet is the type of E-shaped magnetic circuit commonly used for electromagnets powered by alternating currents and the way the contact-holders are assembled is consequently appropriate to the invention. However, this mode is difficult to implement for the blade-type movable framework used in electromagnets powered by direct currents, the blade being too thin to allow a fastening pin to pass through it.

U.S. Pat. No. 5,281,937 discloses a contactor-type electromagnetic switching device comprising a movable framework of an electromagnet consisting of a plane blade whose shape is suitable for it to be fastened to the mobile contact-holder of the contactor by means of elastic clipping feet provided on the contact-holder. However, this fastening method cannot be adapted directly to a movable framework consisting of an E-shaped magnetic circuit.

SUMMARY OF THE INVENTION

The invention thus relates to an electromagnetic switching device in which the different types of movable electromagnet frameworks (particularly depending on whether they are AC or DC powered) may be assembled using the same movable contact-holder, this associations being advantageously achieved rapidly, thereby allowing a considerable reduction in the number of different parts required to manufacture an entire range of contactors.

According to the invention the switching device comprises a movable contact-holder fitted with a set of contact bridges and includes an electromagnet composed of a coil, a fixed framework and a movable framework. This movable framework is fitted by being clipped onto the movable contact-holder by assembling means suitable for both direct and indirect assembly. Said assembling means comprise at least one elastic clipping foot on the movable contact-holder. For example, assembly is said to be direct when the movable framework of the electromagnet is a magnetic blade comprising direct assembling means composed of two pins on the blade that clip directly into the elastic feet of the movable contact-holder. Assembly is said to be indirect when the movable framework of the electromagnet is, for example, a movable magnetic circuit comprising indirect assembly means composed of an intermediary part constructed as part of said magnetic circuit that can be clipped into the elastic feet of the movable contact-holder.

BRIEF DESCRIPTION OF THE DRAWINGS

Other characteristics of the present invention will be better understood from the following description which refers to the attached figures where.

DETAILED DESCRIPTION OF THE PREFERRED EMBODIMENTS

Figure 1:
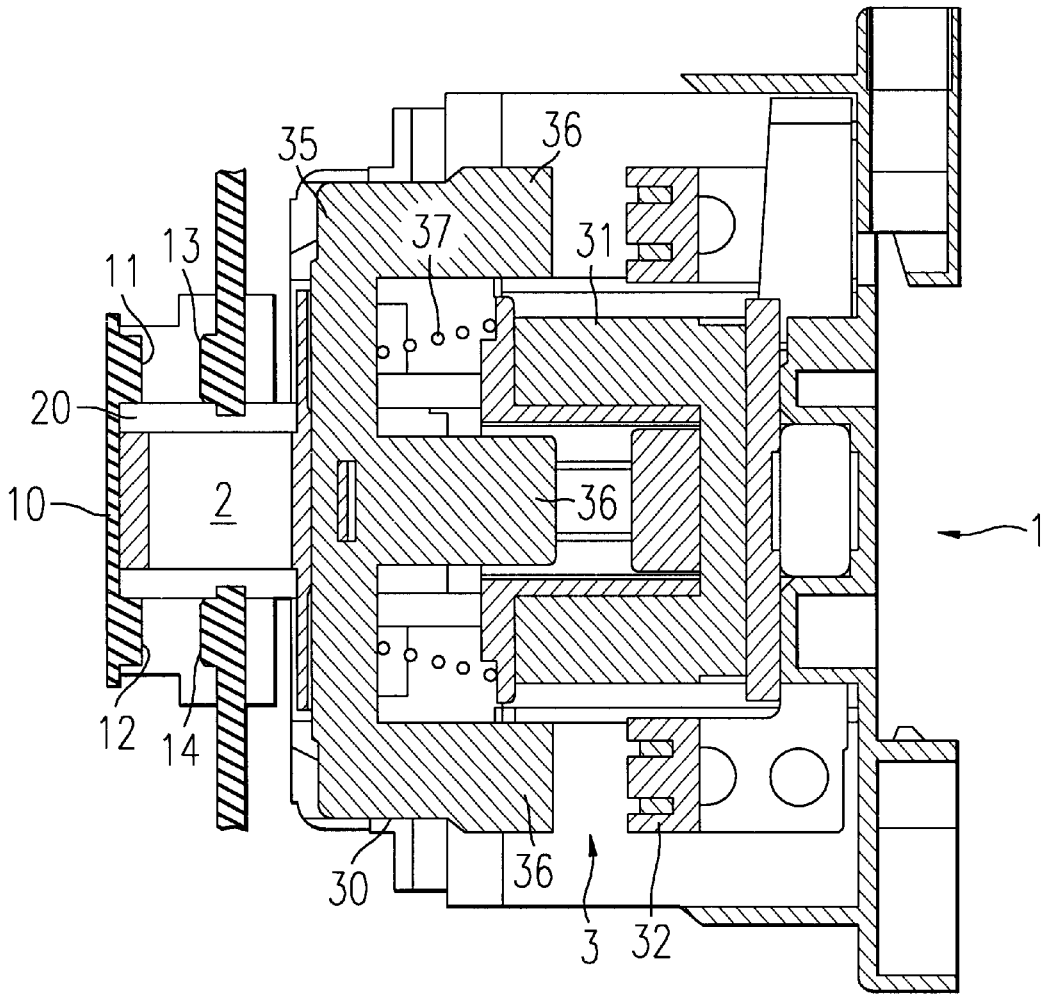
FIG. 1 is a cross-section of the electromagnetic switching device of the invention.

The switching device 1 shown in FIG. 1 is an electromagnetic contactor comprising various dual cutoff power poles.

Each power pole comprises a bridge of movable contacts 10 fitted with contact studs 11 and 12 that operate in conjunction with fixed contacts 13 and 14. Each contact bridge 10 is fitted in a central protective housing 21 in the body of a movable contact-holder 2. The movable contact bridges 10 are displaced by the translation movement of movable contact-holder 2 which is activated by means of an electromagnet 3.

In FIG. 1 electromagnet 3 comprises a coil 31, a fixed framework 32 and a plunging-type movable framework 30 that is subject to force provided by conical spring 37 that is mounted on the framework, the spring being slack when the said framework is in the rest position. When movable framework 30 is attracted to the fixed framework 32, it causes movable contact-holder 2 to move in translation and close the contacts. When the movable framework 30 is moved to its rest position by the spring 37 changing from its compressed to its slack position, the contacts are opened.

The body 20 of the movable contact-holder is extended towards the electromagnet 3 by two lower sections 22 located on either side of contact-holder 2. The movable framework 30 of the electromagnet is fastened to the two lower sections 22 of the contact-holder 2 by clip-type assembly means. On contact-holder 2 these assembly means consist of at least one elastic clipping foot 23. In one preferred embodiment each lower section 22 of the contact-holder 2 has an elastic clipping foot 23 each of which has a fastening notch 24 facing into the body 20 together with, located underneath said fastening notch 24, an internal oblique lateral bevel 24*a*. Each notch 24 also has an upper edge 24*b* turned towards the body 20.

Figure 2:
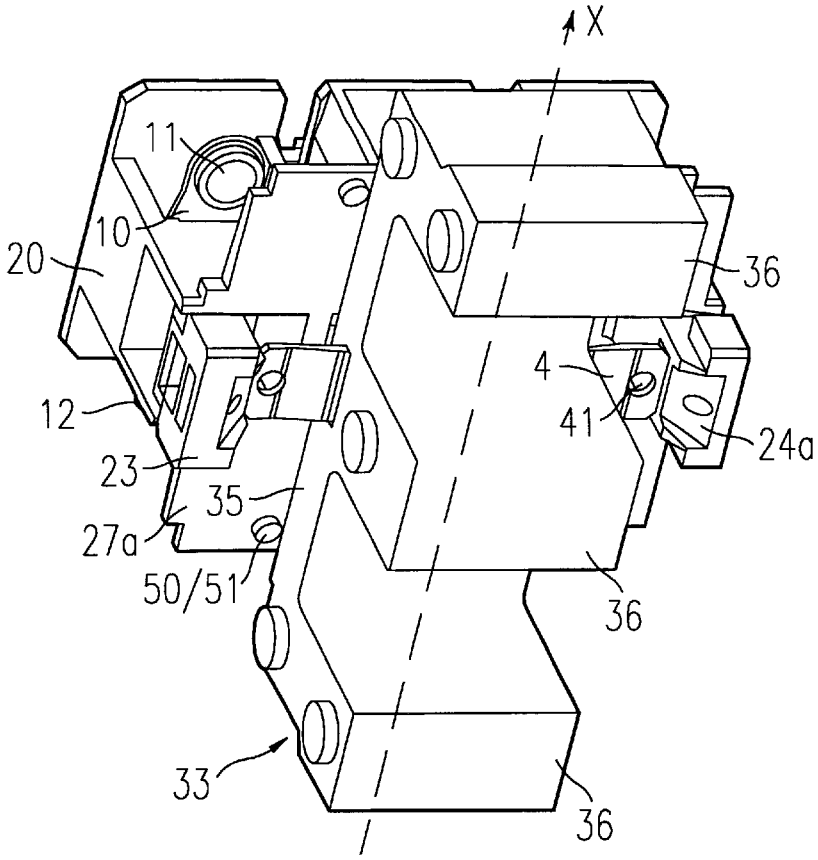
FIG. 2 is a perspective view of the movable contact-holder of the device associated with a first type of moveable electromagnet framework.
Figure 3:
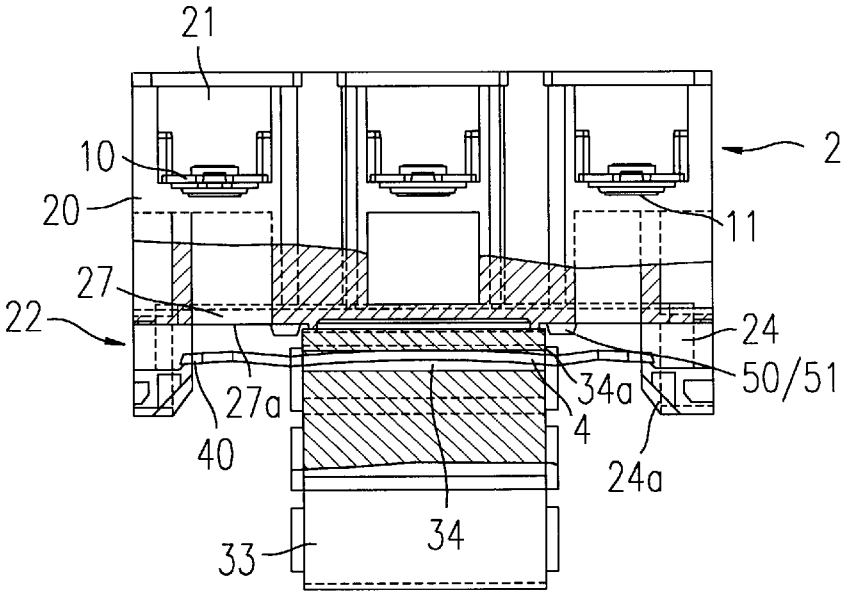
FIG. 3 is a cross-section of the assembly shown in FIG. 2.

In the example shown in FIG. 2 movable framework 30 is an E-shaped laminated mobile magnetic circuit comprising a core 35 with a longitudinal axis X, a rectangular cross-section aperture 34 that runs through core 35 transversal to longitudinal axis X and three frameworks 36 perpendicular to the core designed to be attracted by the fixed framework 32 when a current is passed through coil 31. This type of movable framework is generally used for an AC electromagnet.

The means for indirectly assembling movable magnetic circuit 33 to contact-holder 2 consist of an intermediate part such as a metal key 4 that is required because the measurements of movable circuit 33 are not suitable to allow for the elastic feet 33 to separate. Key 4 is more or less rectangular in shape and has two ends 40 running lengthwise. It is fastened to movable circuit 33 by being elastically inserted into aperture 34 in core 35. Once inserted, key 4 has a longitudinal curve that enables it to stay in position by pressing against the inner surfaces of aperture 34. Lastly, key 4 is sufficiently long to be clipped between the two elastic feet 23 but with sufficiently small depth and thickness to allow its ends 40 to be housed inside notches 24.

Figure 4:
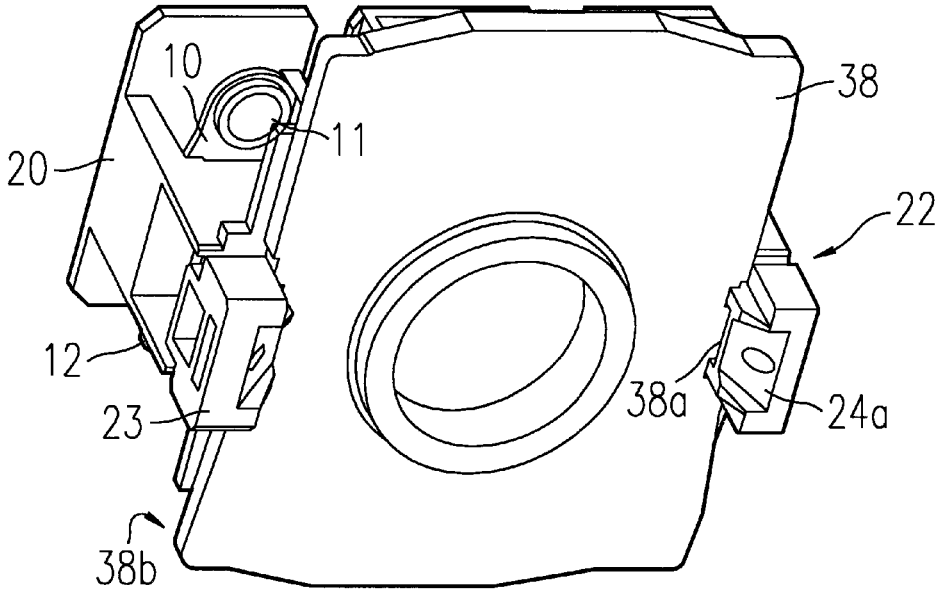
FIG. 4 shows the assembly of FIG. 2 fitted with a second type of movable framework.
Figure 5:
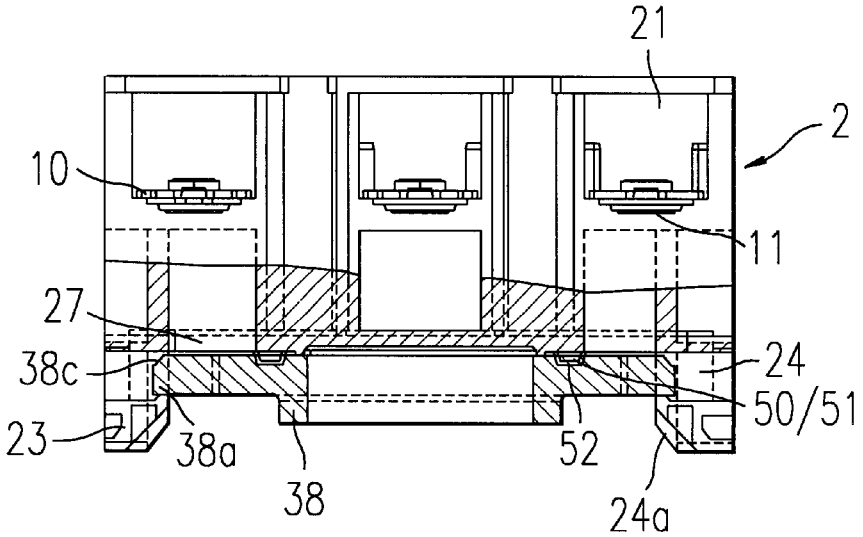
FIG. 5 is a cross-section of the assembly shown in FIG. 4.

In the example shown in FIG. 4 movable framework 30 is the type of more or less rectangular magnetic blade 38 commonly used for DC electromagnets and has a plane upper surface 38*b* facing contact-holder 2. The means for directly assembling the movable magnetic blade 38 onto the contact-holder 2 consist of two pins 38*a* located on opposite edges of blade 38. These edges have a chamfer 38*c* and are designed to be clipped directly into the elastic feet 23 of movable contact-holder 2.

In addition, an insulating flange 27 located under the central housings 21 and above elastic feet 23 separates the power poles from the movable framework to avoid any damage to the electromagnet during arcing when the contacts are opened.

The measurements of the lower section 22 of the movable contact-holder relative to the position of elastic feet 23 and insulating flange 27 are calculated so that the movable framework 30 is pressed against an lower surface 27*a* of the said flange to save space inside the device. Positioning means 50 are provided on the said flange to reinforce the abutment of the movable framework and ensure that it is pressed against insulating flange 27. These means consist of two bosses 51 placed on the lower surface 27*a* of flange 27. The bosses are advantageously separated by a distance equivalent to the width of the core 35 of E-shaped movable circuit 33 so that they operate in conjunction with the edges of the core so that it is positioned and fits between said two bosses.

The thickness of the magnetic blade 38 is calculated so that once it has been assembled with contact-holder 2 it can rest directly on the upper edges 24*b* of the notches 24 and against the lower surface 27*a* of flange 27. Means 52 to complement means 50 are provided on upper surface 38*b* of blade 38. Said complementary means 52 may consist of cavities that operate in conjunction with bosses 51 to position and anchor blade 38 against insulating flange 27.

Figure 6:
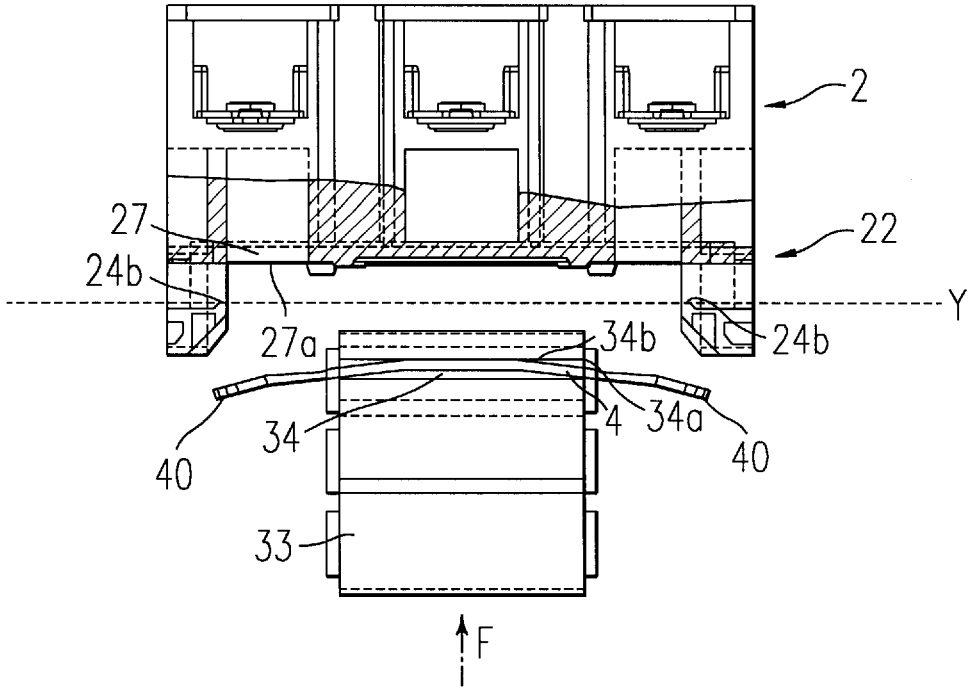
FIGS. 6 and 7 show how the contact-holder and the movable framework of FIG. 2 are assembled.
Figure 7:
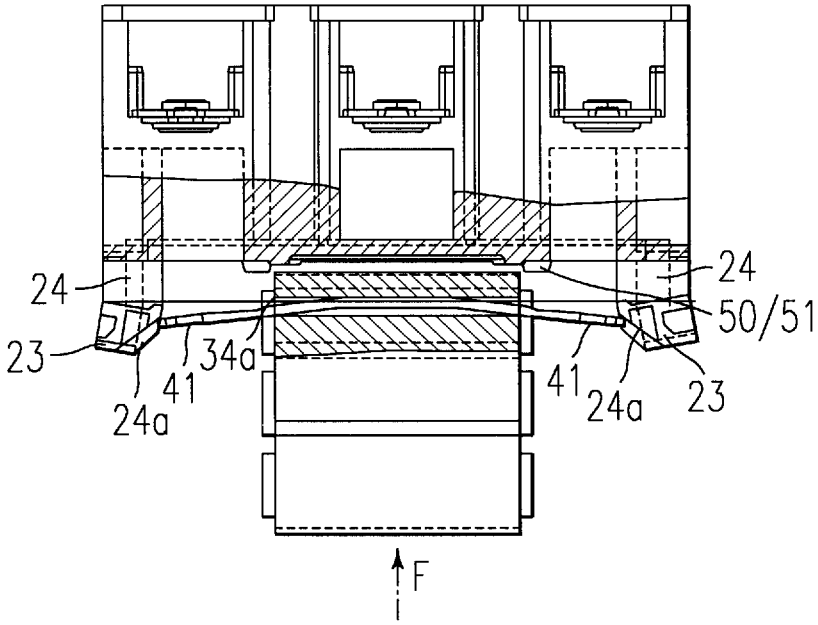

As shown in FIGS. 6 and 7, the movable framework of the electromagnet is clipped onto movable contact-holder 2. Movable framework 30, in this case E-shaped movable circuit 33, is brought near the lower section 22 of the movable contact-holder parallel to the lower surface 27*a* of flange 27, key 4 being positioned in an axis Y that passes through the two elastic feet 23. The ends 40 of key 4 are then pressed against the oblique bevels 24*a* of elastic feet 23, then when they are pushed towards the flange in the direction indicated by arrow F, the elastic feet 23 separate towards the outside of body 20 of the movable contact-holder to enable ends 40 of the key to enter notches 24. When the ends are inserted, releasing movable circuit 33 causes the elastic feet 23 to return to the rest position, thereby retaining the framework. In order to facilitate fitting, key 4 has two apertures 41 near its ends 40. A tool designed to exert the movement required to clip the movable circuit in place fits into these two apertures.

Aperture 34, which is rectangular in cross-section, has four internal surfaces of which upper internal surface 34*b* is the nearest to insulating flange 27. The two ends of aperture 34 form four edges at right angles with core 35 of magnetic circuit 33, upper edge 34*a* matching the edge formed by upper inner surface 34*b*. Once movable framework 33 has been fitted into movable contact-holder 2, the shape of key 4 has a longitudinal curve which ensures that it is only maintained by three points of contact, i.e. the two ands 40 of key 4 resting on the upper edges 24*b* of fastening notches 24 (see FIGS. 6 and 7); in addition, the central section of key 4 rests on the upper internal surface 34*b* of aperture 34. Thus by bearing on the upper edges 24*b* of notches 24, they key 4 exerts elastic pressure on the upper inner surface 34*b* of aperture 34, thereby helping to press movable circuit 33 against the lower surface 27*a* of the flange 27 of contact-holder 2 between the two bosses 51. In addition, the longitudinal curve of key 4 prevents it coming into contact with upper edges 34*a* of aperture 34, thereby avoiding premature wear of the key after a certain number of movements by the electromagnet of the electromagnetic contactor.

Assembly is identical when the movable framework of the electromagnet is a blade 38. Once the blade has been brought close to the lower section 22 of the movable contact-holder parallel to lower surface 27*a* of flange 27, the chamfers 38*c* of the two pins 38*a* press against the oblique bevels 24*a*; then when the blade 38 is pushed in the direction indicated by arrow F, the elastic feet 23 separate towards the outside of body 20 of the movable contact-holder to enable the pins 38*a* of the blade to enter notches 24 in the elastic feet.

What is claimed is:

1. Electromagnetic switching device comprising:

a movable contact-holder fitted with a set of contact bridges that bear movable power contacts that operate in conjunction with fixed contacts, the movable contact-holder having an assembly device including at least one elastic clipping foot, said movable contact-holder having an insulating flange; and an electromagnet including a coil, a fixed framework and a movable framework, the movable framework clipping onto the movable contact-holder by the assembly device, wherein said assembly device is configured to provide for both direct and indirect fitting of the movable framework onto the movable contact-holder, said movable contact-holder including positioning means on a lower surface of the insulating flange and configured for contacting and positioning edges of the movable framework when the movable framework is in indirect fitting with the assembly device.

2. Electromagnetic switching device according to claim 1, wherein the movable framework of the electromagnet includes a movable magnetic circuit that is E-shaped, having a longitudinal core, and indirect assembly means enabling the movable magnetic circuit to be fitted to the movable contact-holder, characterized in that said indirect assembly means comprise a key that is fastened to the movable framework by being elastically inserted into an aperture in the core of the movable circuit, the two ends of which are configured to clip into the at least one elastic foot of the movable contact-holder.

3. Electromagnetic switching device according to claim 2, characterized in that the key has a longitudinal curve that enable it to exert elastic pressure, thereby helping to press movable circuit against the movable contact-holder while preventing the key from coming into contact with upper edges of the aperture.

4. Electromagnetic switching device according to claim 1, wherein the movable framework of the electromagnet includes a magnetic blade fitted with direct assembly means that enable the magnetic blade to be directly fitted to the movable contact-holder, characterized in that said direct assembly means comprise two pins located on opposite edges of blade and configured to be clipped into the elastic feet of the movable contact-holder.

5. Electromagnetic switching device according to claim 1, characterized in that the movable contact-holder comprises central housings that receive movable contact bridges and said insulating flange that has a lower surface, said insulating flange being located between central housings and elastic feet in order to protect the electromagnet when the contacts open.

6. Electromagnetic switching device according to claim 1, characterized in that the insulating flange is provided with the positioning means on its lower surface for ensuring that a blade or a movable circuit is pressed against the flange.

7. Electromagnetic switching device according to claim 6, characterized in that the positioning means includes at least two bosses placed on the lower surface of the insulating flange.

8. Electromagnetic switching device according to claim 6, characterized in that the positioning means is separated by a distance equivalent to the width of the core of the movable circuit.

9. Electromagnetic switching device according to claim 6, characterized in that the upper surface of the blade is fitted with complementary means configured to operate in conjunction with the positioning means located on the lower surface of the insulating flange.

10. Electromagnetic switching device according to claim 9, characterized in that the complementary means located on the blade includes cavities configured to receive bosses on the insulating flange.

* * * * *